United States Patent [19]

Berns et al.

[11] 3,980,997

[45] Sept. 14, 1976

[54] SMOKE DETECTOR

[75] Inventors: Charles Berns, New Milford; Vaclav O. Podany, Norwalk, both of Conn.

[73] Assignee: General Signal Corporation, Stamford, Conn.

[22] Filed: July 17, 1974

[21] Appl. No.: 489,076

[52] U.S. Cl. ..... 340/237 S; 250/552; 250/574

[51] Int. Cl.[2] ..... G08B 17/10

[58] Field of Search ..... 340/237 S, 228; 250/552, 573, 574, 575, 576, 565; 356/206, 207

[56] References Cited

UNITED STATES PATENTS

| | | | |
|---|---|---|---|
| 2,604,597 | 7/1952 | Cahusac et al. | 340/237 S X |
| 3,185,975 | 5/1965 | Kompelien | 340/237 S |
| 3,313,946 | 4/1967 | Goodwin et al. | 340/237 S X |
| 3,383,670 | 5/1968 | Roberts | 340/237 S |
| 3,409,885 | 11/1968 | Hall | 340/237 S |
| 3,474,435 | 10/1969 | White et al. | 340/237 S |
| 3,544,798 | 12/1970 | Topol | 250/573 |
| 3,585,621 | 6/1971 | Dicello | 340/237 S |
| 3,774,186 | 11/1973 | Enemark | 340/237 S |

FOREIGN PATENTS OR APPLICATIONS

| | | | |
|---|---|---|---|
| 919,640 | 2/1963 | United Kingdom | 250/565 |
| 1,222,351 | 2/1971 | United Kingdom | 340/237 S |

*Primary Examiner*—John W. Caldwell
*Assistant Examiner*—Daniel Myer
*Attorney, Agent, or Firm*—Milton E. Kleinman; John F. Ohlandt

[57] ABSTRACT

Smoke detection apparatus including a pair of photoelectric cells which receive illumination selectively from a very low level light source. One of the cells is termed the "direct" cell because it is in the direct path or on the axis of a narrow conical beam of light emanating from the source, the other cell being termed the "reflected" cell because it receives a significant part of its light input upon reflection of light from smoke particles or the like as such particles are drawn into the path of the light beam. Under predetermined smoke conditions, i.e., when there is smoke obscuration of the light of 2% per foot (.01 optical density), an alarm signal is triggered. The very low level light source is a light-emitting diode which sensitively monitors the smoke obscuration; only a slight change in the illumination to the pair of photocells, connected in a sensing circuit, is required to produce the triggering signal. Accordingly, the smoke detection apparatus is highly sensitive to the presence of either so called "white" smoke or "black", i.e. non-reflective smoke, and either or both will trigger the alarm signal.

14 Claims, 5 Drawing Figures

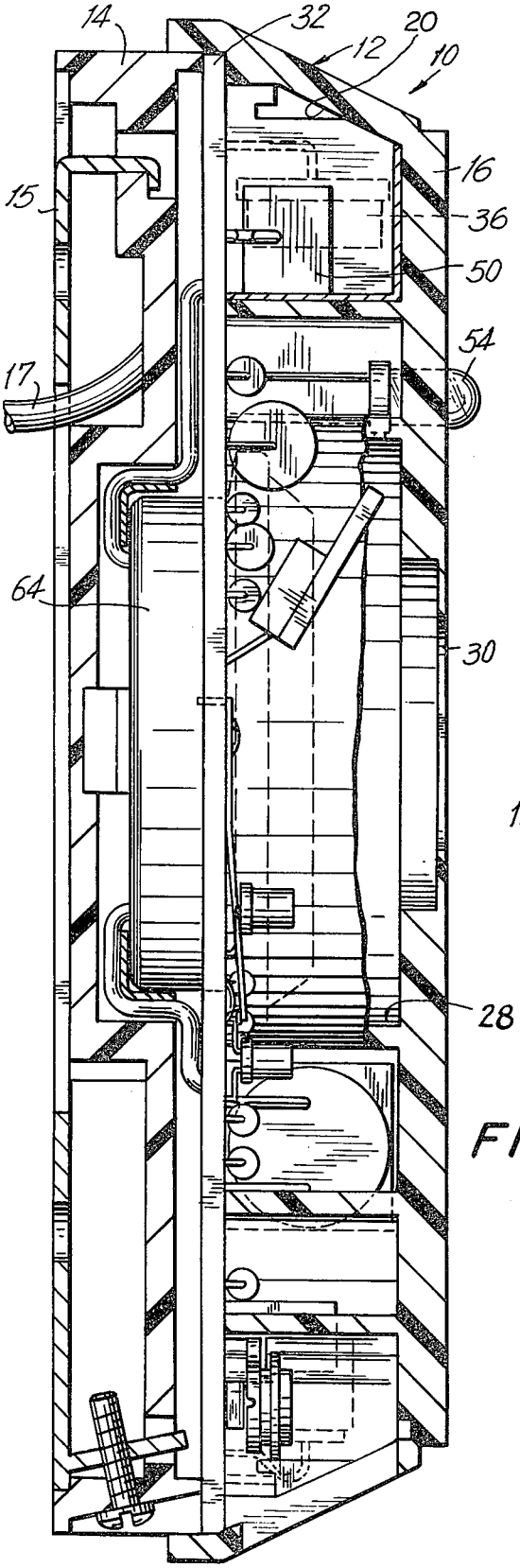
FIG. 2
FIG. 1
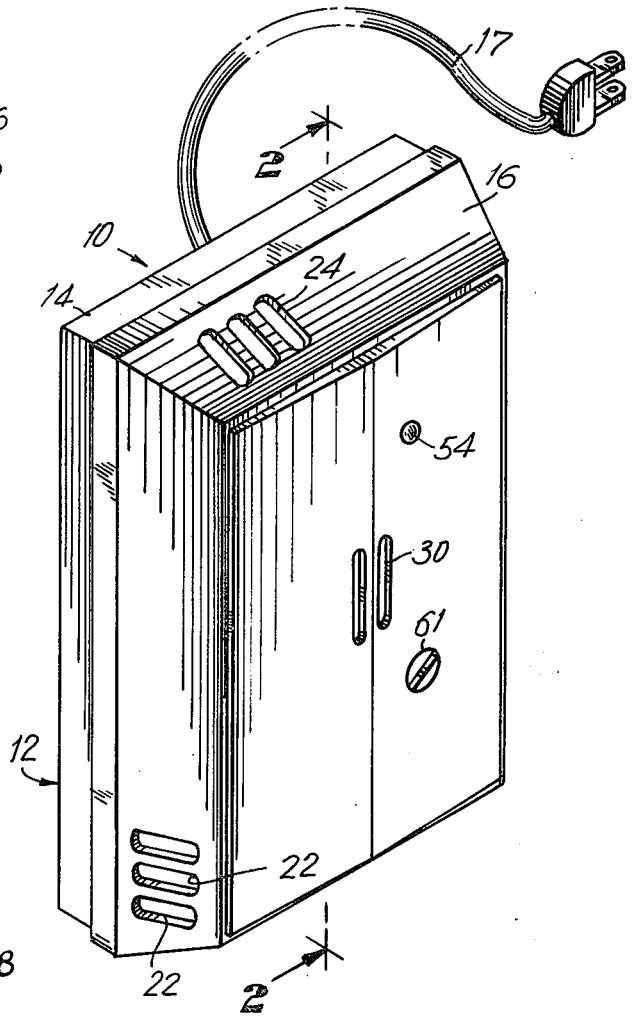
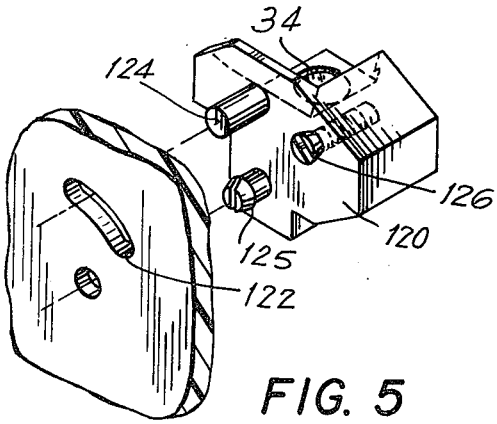
FIG. 5

SMOKE DETECTOR

BACKGROUND, OBJECTS AND SUMMARY OF THE INVENTION

The present invention relates to smoke detection apparatus, and more particularly, to apparatus for detecting the presence of smoke or other solids under a variety of conditions.

It is a well-known fact that early and reliable indication of the presence of smoke in a building or the like can do much to save lives inasmuch as a tremendous number of persons are killed due to smoke inhalation prior to the actual consumption of the portion of the building structure in which the victims happen to be located.

A variety of apparatus has been proposed in the prior art for detecting the presence of smoke, it being a common practice to provide apparatus including an exciter lamp which functions to illuminate a dark space in which particulate matter such as smoke is to be detected. Also included as part of such apparatus is a pair of photocells which operate to view the enclosed space. The reason that a pair of photocells is conventionally utilized is that a photocell's reponse to light reflected or scattered from the particulate matter in the smoke being detected varies with age, temperature, applied voltage and change of lamp illumination, as well as other factors. Accordingly, the pair of photocells is incorporated in a balanced circuit arrangement such that the aforesaid deleterious effects tend to cancel out.

In order to provide a representative sample of prior art schemes for smoke detection so as to furnish background for the subject matter of the present invention, reference may be made to U.S. Pat. No. 3,409,885, and also to U.S. Pat. No. 3,723,747 and U.S. Pat. No. 3,727,056.

Whatever the merits of the various schemes and systems heretofore proposed, it has been recognized by the present inventors that a nunmber of serious drawbacks are involved. For example, although certain kinds of balanced-circuit arrangements help to alleviate problems associated with a photocell response, yet such arrangements have not been entirely satisfactory in that any imbalance in the light intensities between the two photocells leads to a disparity between the sensitivity of the two cells after an extended period of time.

A particularly troublesome set of difficulties are those presented when an incandescent light source is to be utilized as the source to be monitored within the smoke detection chamber. As is well known, such a source has a relatively short useful life of the order of several years. Moreover, replacement in service is quite often required and, in fact, when used as the light source in a smoke detector, a replacement lamp is often included as part of the purchased unit. An incandescent light source also generates an excessive amount of heat and "noise"; that is to say, it generates such a high degree of illumination that much of the light is scattered throughout the enclosure and is not absorbed by the blackened interior thereof.

It is therefore a primary object of the present invention to provide a smoke detection device or apparatus that can successfully exploit the inherent advantages of a solid state, low illumination level lamp as the light source. Such a light source has an extremely long life of over 20 years and therefore should not need replacement.

A further object is to keep the power dissipation requirements on such a solid state source to a minimum by operating the source at an extremely low level of illumination and therefore a low level of current.

Yet another object of the present invention is to permit such low level of illumination, and yet to realize or produce the required sensitivity even though the illumination received by the photocells under smoke conditions varies only slightly from the normal illumination. The sensitivity requirement on a smoke detector is such that it must respond to visible smoke obscuration of light of approximately 2% per foot (0.01 optical density). This requirement or specification is satisfied by the present invention with as small a change in illumination of the photocells as 10% of the normal total illumination. By normal total illumination is meant the illumination received by both photocells under normal conditions, that is when no smoke is present in the detection chamber.

A further object is, through the use of a solid state light source, to provide a small, portable, inexpensive and reliable unit that can be employed in the home and which will not require frequent servicing.

Another object of the invention is to provide a smoke detector which insures that a significant flow of air will constantly be maintained through the detector so that the smoke content can be continuously monitored.

A further requirement, which must be fulfilled for satisfactory and reliable operation of a smoke detection device, is that if the device is to include a solid state light source having a low level light output, the device must be able to respond and to give an alarm when the smoke possesses widely different characteristics. Thus, the smoke detector must be highly sensitive to the presence of either so-called white smoke or black, that is non-reflective, smoke.

Accordingly, it is another object of the present invention to provide a smoke detection device that will respond reliably to widely disparate smoke characteristics even though the light illumination is at relatively low level.

The above and other objects of the invention are fulfilled and implemented by a primary feature of the present invention which provides apparatus for detecting the presence of smoke, such apparatus comprising a housing defining an enclosure for the detector; a detection chamber within the enclosure for permitting a continuous air flow so that smoke present therein may be monitored; a solid state low level light source mounted within said enclosure; first and second light receiving means mounted within the enclosure (the first means being preferably arranged to receive approximately 70% of the total normal illumination received by both measuring means and the second means arranged to receive approximately 30%); a sensing circuit, connected to a threshold means, said first and second light receiving means, the sensing circuit being operable to actuate the threshold means whenever there is a change in the illumination received by either of said light receiving means as small as 10% of the normal total illumination; and alarm signal means electrically connected to said threshold means and actuated thereby to produce an alarm signal.

The first light receiving means mentioned above is constituted by a first photocell, termed a direct photocell because it is in the direct path of illumination from the light source. This direct photocell is predominantly responsive to black smoke, the conductivity of this photocell decreasing significantly as the presence of black smoke increases. The second light receiving means is constituted by another photocell, termed the "reflected" photocell, which is predominantly responsive to white smoke, the conductivity of this photocell increasing significantly as the presence of white smoke increases.

The pair of photocells referred to above is connected in a sensing circuit so as to initiate an alarm when any of the following conditions occurs: (a) black smoke is present in the smoke chamber whereby the conductivity of the direct photocell decreases, or (b) white smoke is present such that the conductivity of the indirect photocell increases, or (c) a mixture of black and white smoke in variable proportions is present in the smoke chamber such that the conductivity of the direct photocell decreases and the conductivity of the indirect photocell increases.

The sensing circuit is connected, as noted previously, to the alarm threshold means which is activated only when a predetermined difference in potential at the output of the sensing circuit, due to the disparity from the normal conductivity in the two photocells, exceeds a predetermined value. The alarm threshold means includes a programmable unijunction transistor (PUT) switch which actuates an alarm device upon its being switched by the sufficiently great potential difference at its input.

Under normal circumstances, that is, when no smoke is present within the detection chamber, the differential voltage applied at that time between one of the main electrodes and the gate electrode of the unijunction transistor has a value of zero volts. Thus, the normal illumination received by both cells is suitably proportioned such that this zero differential is obtained.

The particular adjustment of the light source so as to produce the aforesaid proportioning of the illumination constitutes a further feature of the present invention. By this feature the illumination received by the direct cell is initially arranged to be approximately 2.5 times the illumination received by the reflected cell. Then, instead of adjusting a separate resistance in a circuit with the photocell, the light beam axis is changed slightly. This has been found to be an efficacious adjustment; and one that eliminates several difficulties, one of which is that the neutral density filter transmission becomes less critical. Also, the match required between photocell resistances becomes less critical, as will be made apparent as the description proceeds. This lessening of the criticality of the photocell resistances results from the fact that these are being effectively determined by the degree of illumination received due to the precisely adjusted setting of the light beam axis.

In accordance with another feature of the present invention the amount of light impinging on the direct photocell is reduced by a single neutral filter having a light transfer of 0.1% to 0.5%.

Yet another feature of the present invention resides in the provision of reflective strips, associated with a heat generating resistor, all being located near the air flow outlet from the detector device. Such an arrangement enables the detector to operate with efficient air flow whether in a position resulting from being mounted on the ceiling, or from being mounted on a wall.

A further feature of the present invention resides in a unique arrangement for providing a "trouble" signal when either or both of the light producing devices in the detector have failed. This arrangement utilizes the same device that serves to indicate the presence of smoke, but does so with a markedly different audible signal.

The above objects, features and advantages of the present invention will be understood, as well as additional aspects thereof, by reference to the following detailed description of a preferred embodiment and to the accompanying drawing, in which:

BRIEF DESCRIPTION OF THE DRAWING

FIG. 1 is a perspective view of a complete smoke detector unit in accordance with a preferred embodiment of the present invention.

FIG. 2 is a sectional view taken on the line 2—2 through the unit illustrated in FIG. 1.

FIG. 5 is an exploded perspective view of the apparatus for practicing the light axis adjustment technique of the present invention.

DESCRIPTION OF PREFERRED EMBODIMENT

Figure 3:
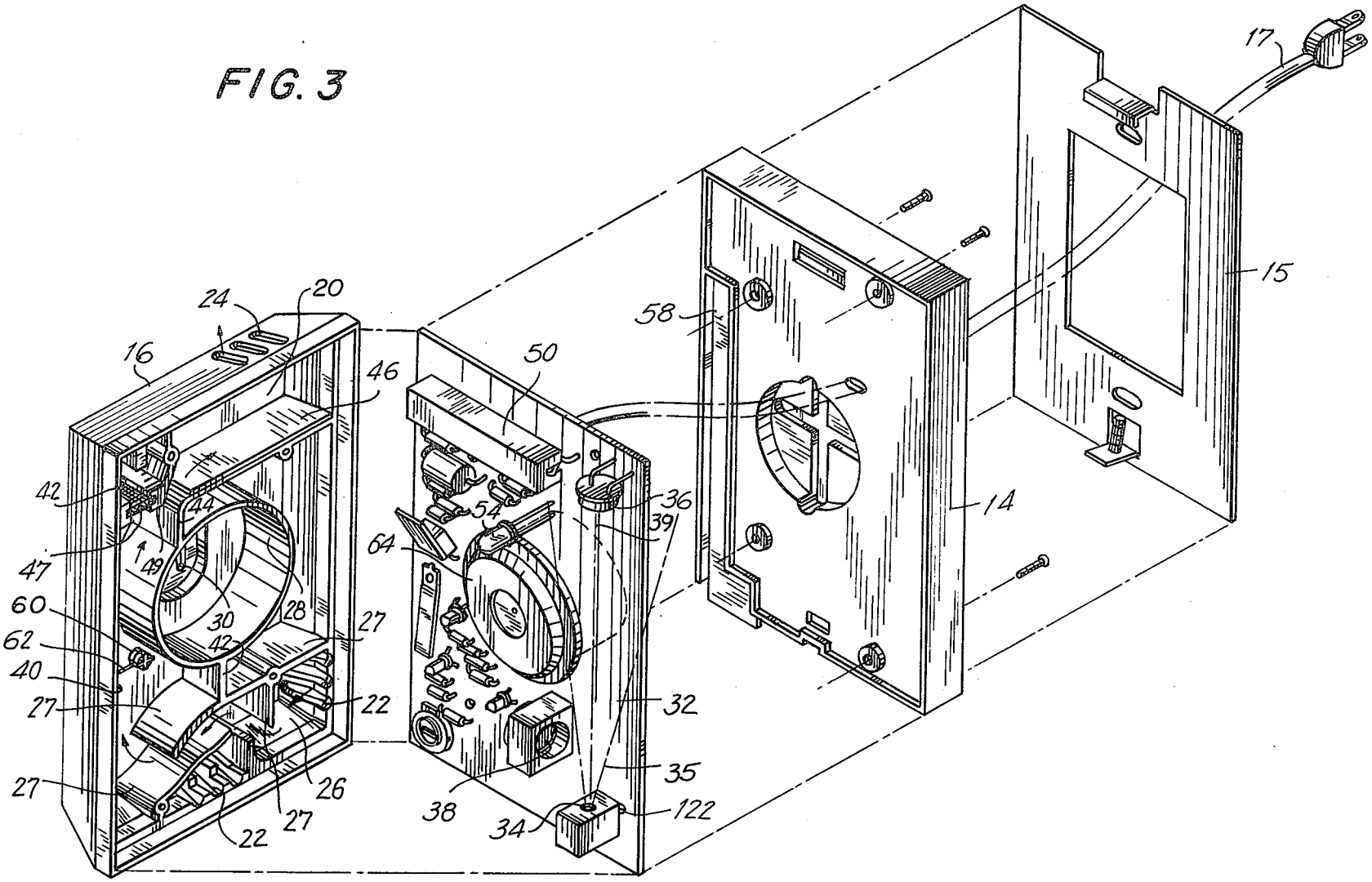
FIG. 3 is an exploded perspective view particularly showing the interior of the smoke detector unit.

Referring now to the figures, and particularly for the moment to FIGS. 1–3, there will be seen a smoke detector device 10 constructed in accordance with a preferred embodiment of the invention. The smoke detector comprises a housing 12, which includes a base plate or mounting member 14 adapted to be connected to a bracket 15 or the like for wall or ceiling mounting of the device, and a cover 16 which is arranged to be suitably affixed to the base plate 14.

The housing 12 encloses the essential components of the smoke detector, and extending from the housing there will be seen a power cord 17, including a conventional plug for insertion in a household socket. This power cord is supplied with particular models embodying the present invention; however, other models which also embody the invention may differ in having a power connection made directly to a junction box or the like. Furthermore, certain so-called "tandem" models may include three-wire connections, by which remote actuation of an alarm signal can be realized.

The housing 12 defines an enclosure 20, having one or more inlet openings 22 formed, for the particular embodiment illustrated, in the cover 16; also, an outlet opening 24 is provided in the cover. These openings allow for the passage of air, as indicated by arrows, into and out of the enclosure 20. The inlet openings 22 communicate with a labyrinthine passageway 26 formed by irregular partitions 27 which are integrally formed in the cover 16. The outlet area is similarly designed so that the entire enclosure is, for this reason and because of the use of light-absorbent surfaces throughout, substantially light tight. The cover 16 includes a well 28 adapted to receive a portion of an alarm device and is so designed that although an opening 30 permits sound to be emitted to the ambient, substantially no light transmission is possible to the interior of the housing.

When the cover 16 is firmly in place, that is, when affixed to the base or mounting plate 14, the inner parts of the cover abut at selected locations with a printed circuit board 32 (FIG. 3) which is affixed to the base plate 14. The circuit board 32 is also painted or otherwise treated so as to be light absorbent. Mounted on the board 32 are most of the essential components of the smoke detector device.

As seen particularly in FIGS. 3 and 5, a light source 34 in the form of a light emitting diode is situated within the enclosure 20. Light from this source is directed in a narrow conical beam 35 at the photoelectric cell 36. Another photoelectric cell 38 is situated off to the side, away from the axis 39 of the narrow beam of light being transmitted so that there is a much lesser impingement thereon, compared with cell 36, under normal circumstances. Both of the photoelectric cells 36 and 38 are preferably constituted of the same material so that their characteristics are substantially the same.

The light source 34 and the photoelectric cell 38 are situated in a separate chamber 40 within the enclosure 20. This chamber 40 is bounded by the end of the labyrinthine passageway 26, by partitions 42 and 44 extending longitudinally, and partition 46 extending laterally. The aforesaid partitions 42 and 44 meet with the wall of the well 28 which also defines a boundary of the smoke chamber 40. A small compartment 42 is also provided at the corner of the cover 16. A single filter 47 of neutral characteristics is disposed in slots formed in this partition or wall 49 at such corner. The filter 47 is to provide that the amount of light reaching the photocell 36, disposed within compartment 42, is approximately 2.5 times the amount reaching photocell 38.

The air drawn in through the inlet opening 22 passes through the smoke chamber 40. Under normal circumstances the light beam traveling to the photoelectric cell 36 is in no way significantly influenced by the passage of clean air so that the light beam is effective to maintain the conductivity of that cell at a high level so long as such clean air is being drawn in. Continuous passage of air is insured by a chimney effect produced by a heat generating resistor 50, seen at the upper portion of the circuit board and included in a circuit to be described. Heat developed by this resistor results in convection currents such that a significant amount of air is constantly being drawn through the device.

As will be especially seen in FIGS. 2 and 3, another light-emitting diode 54 is upstanding from the circuit board 32 and it is connected in a series circuit (FIG. 4) with the light-emitting diode serving as the light source 34. An opening is provided in the cover so that the light from light-emitting diode 54 may be seen, whereby it can function as a "power on" indication.

It will also be noted in FIG. 3 that the device 10 also includes a slidable arm 58. This arm functions to silence the alarm signal when the user slides the arm all the way out from the housing. Once the smoke detector has cleared, that is, when sufficient clean air has been pushed through the smoke chamber, the arm 58 can be moved in so as to actuate an approximately disposed switch 59 (FIG. 4), thereby to reset the smoke detector. It will also be seen in FIGS. 1 and 3, that a means for simulating a smoke condition is provided in order that the user may test the unit to see that it is functioning properly. This means includes a shaft 60 which extends through the cover 16 and has a knob 61 at the outer end thereof, which can be engaged by a screwdriver for turning the shaft. When the shaft is turned sufficiently in the proper direction a wire element 62 is moved into the path of the beam from light source 34 and the alarm device is thereby triggered.

Figure 4:
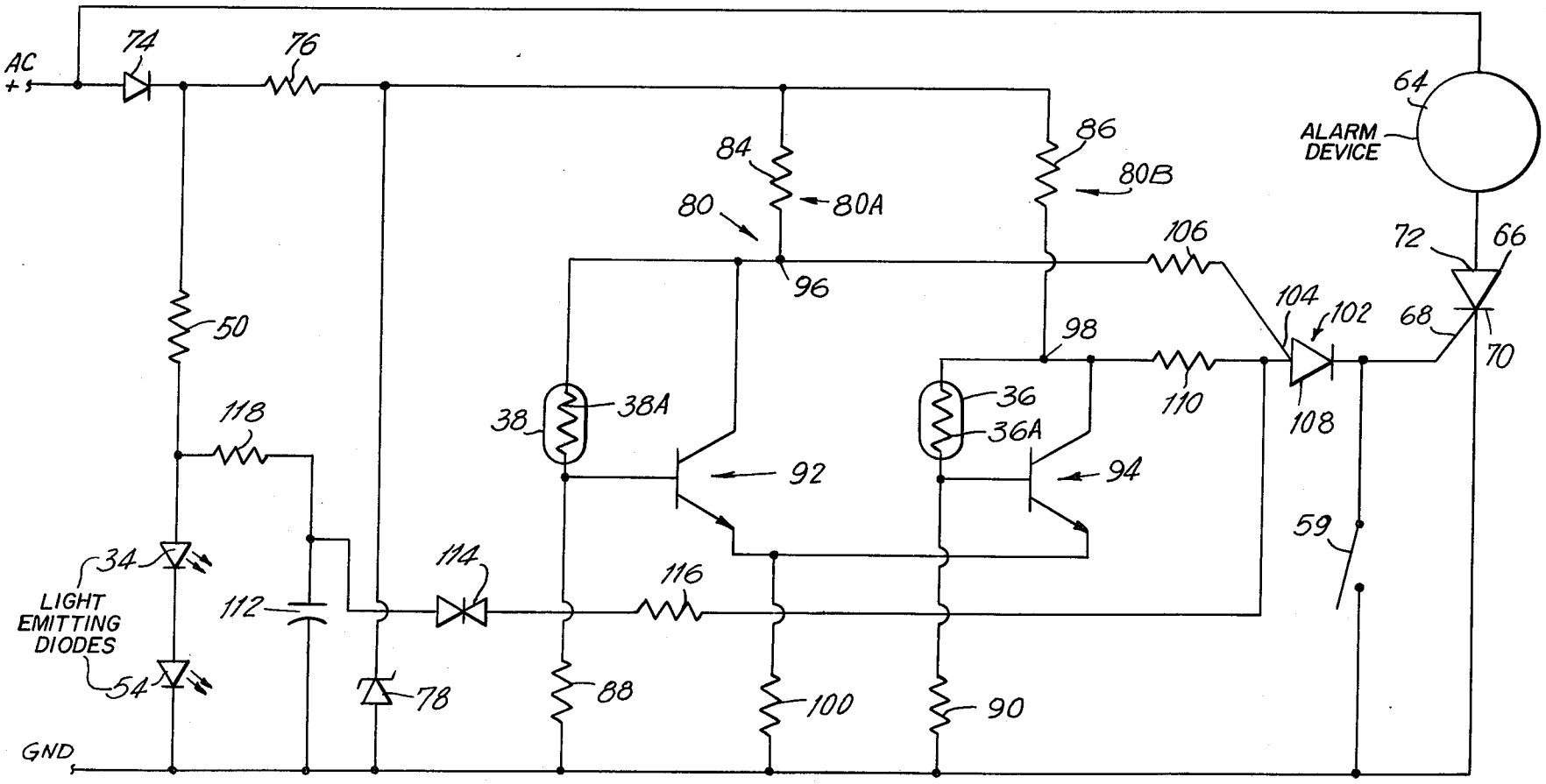
FIG. 4 is a schematic diagram of the electrical circuitry involved in the smoke detector unit.

The crux of the ability of the smoke detection device of the present invention to respond to widely disparate smoke conditions will be understood by particular reference to FIG. 4 in which a schematic diagram of the circuitry is provided. This figure illustrates the present invention's unique ability to actuate an alarm device on an extremely reliable basis irrespective of whether there is black smoke or white smoke present in the smoke chamber, with either present alone or in any combination, and to produce the required actuation in response to either (1) the decreased conductivity of the direct photocell, which is primarily responsive to black smoke, or (2) to the increased conductivity of the indirect photocell, which is primarily responsive to the presence of white smoke. In other words, an alarm threshold is established which responds to a difference in potential resulting from the fact that either one photocell is experiencing decreasing conductivity or the other photocell is experiencing increasing conductivity or both conditions exist at the same time.

The circuit of FIG. 4 includes a source of AC power as indicated by the symbols AC + and GND. Such power is conveyed to an alarm device 64, which is able to conduct current only if a trigger device 66 has been rendered conductive by reason of the application of suitably positive potential to its cathode gate 68, the cathode 70 of the device being connected to ground and the anode 72 thereof to the alarm device.

DC power is derived from the AC source by means of a diode 74 connected to resistor 76, which in turn is connected to Zener diode 78, which functions as a voltage regulating means, thereby supplying a substantially constant voltage to a sensing circuit 80.

It will be noted that DC power is also supplied through the resistor 50 to the two light-emitting diodes 34 and 54, the diode 34, as previously noted, serving as the light source for the smoke detector and the diode 54 functioning to indicate when power has been turned on to the unit.

The sensing circuit 80 is composed of two substantially equivalent halves; that is to say, each of the halves comprises a parallel branch 80A and 80B including respective photocells 36 and 38 as previously noted, the resistances 36A and 38A of which are included in respective bias networks having substantially equal resistances 84 and 86 connected to the one end, and suitably proportioned resistances 88 and 90 connected from the other ends, of the respective photocells to ground. In addition, the parallel branches in the sensing circuit 80 include respective transistors 92 and 94, the collectors of which are connected to respective junctions 96 and 98. The bases of the respective transistors are connected to the lower end of the photocells 36 and 38, the emitters of such transistors being joined together and connected through a common resistor 100 to ground.

A threshold device 102 has its anode gate 104 connected through a resistor 106 to the junction 96, whereas the anode 108 of the device 102 is connected through resistor 110 to junction 98. The threshold device 102, which typically takes the form of a programmable unijunction transistor (PUT) switch, does not fire unless the potential of its anode 108 is more positive than the potential of its anode gate 104. The sensing circuit 80 insures that this will occur only under prescribed conditions. Otherwise, that is, when the smoke detector is in the normal or no smoke condition and the light source 34 is impinging on the direct photocell 36 to such an extent that its resistance 36A is much lower than the resistance 38A of the reflected photocell 38, the result is that a substantially balanced circuit condition exists according to which substantially identical currents flow into the parallel branches 80A and 80B. The result is that a zero potential difference normally exists between the anode gate 104 and the anode 108 of threshold device 102, and consequently, the threshold device is not rendered conductive. This balance condition obtains, despite the fact that the resistance of the photocell 36 is considerably less than the resistance of photocell 38 (the reflected cell); this is because the currents drawn by the photocells are an insignificant fraction of the respective currents flowing through the resistors 84 and 86, such fraction being of the order of 1/100.

It should be noted that, although there is this disparity in the individual currents flowing through the photocells, the base currents to each of the transistors 92 and 94 are substantially identical under no smoke conditions. The equality of base currents under such conditions results from selecting the same ratio between the separate resistances 88 and 90 in each of the parallel circuits 80A and 80B as obtains between the photo resistances 38A and 36A. In other words, since the photo resistance 38A is approximately 2.5 times photo resistances 36A, this same ratio is chosen for the other resistors 88 and 90. Accordingly, substantially the same base bias potential is established for each of transistors 92 and 94 in each of the input voltage divider networks.

The direct photocell 36 is so chosen that under normal, or no smoke conditions, and with the filter 47 of neutral characteristics in place and operative, the illumination received by this cell is of the order of 2.5 times the illumination received by the reflected cell 38. In order to provide a set of typical values, it should be noted that with a light-emitting diode chosen as the source 34 and selected to have an outpt of approximately 0.009 foot candles, the direct cell 36 under normal conditions receives approximately 0.0007 foot candles, while the reflected cell 38 receives 0.0003 foot candles, the total illumination received by both cells being 0.0010 foot candles.

Altough the relationship is not precisely linear the differential illumination on the two cells results in a difference in the resistance which is of about the same order, that is to say, the normal ratio of the resistances of the photocell is also approximately 2.5; the differential illumination is in about the same ratio since the illumination received by the direct cell is about 70% of the total illumination received by both cells, whereas the illumination received by the reflected cell is 30% of the same figure. However, the precise relationship will vary depending upon the material which constitutes the photocells 36 and 38. In the present embodiment these materials have been chosen and the various parameters selected such that the change effected in the photocell resistance is twice the change in illumination. In other words, when the illumination changes due to smoke conditions, this change can be as little as 10% of the total normal illumination, with the consequence that the resistance of the photocells, either singly or together, will experience a change of approximately 20%, this amount being sufficient to cause a biasing differential that will trigger the threshold device, as already noted.

The photocells 36 and 38 are also selected to have a small temperature coefficient. In other words, there will be very little change in their photo resistance with change in temperature. Also, a further consideration is that the photocells have a fast response time, by which is meant that the resistance of the photocells will change quickly with change in illumination. A preferred material for the photocells 36 and 38 is a combination of cadmium sulphide and cadmium selenide, such material being available from manufacturers specializing in such components.

The amplifying transistors 92 and 94 are chosen to have identical characteristics and in fact are the same transistor type (2N 33 93). As noted previously in connection with the input biasing arrangement, including the individual photocells and the respective resistors 88 and 90 each of which is connected to ground, it will be understood that the individual base currents to the transistors 92 and 94 are used to set the quiescent operating points for the collectors of these transistors. The emitters of both transistors are tied together and are connected to ground through the common resistor 100. Such arrangement provides what is known as common-mode rejection and prevents spurious noise signals from interfering with the proper operation of the sensing circuit 80.

The amplification factor, or beta, of the transistors 92 and 94 has a value of approximately 100 so that it will be appreciated that this results in the aforenoted ratio of 1/100, between the individual currents through the photocells and the currents through the respective resistors 84 and 86. The collector currents are, as will be understood, almost equal to the currents flowing through the resistors 84 and 86. The collector current values, which are normally equal through both of the resistors 84 and 86, are approximately 0.5 milliamp. However, the currents through the aforesaid resistors 84 and 86 are changed significantly when either or both of the respective photocells 36 and 38 are affected by as little as a 10% change in illumination received by them, whereby actuation of the alarm signal is effected.

Let it be assumed first that the aforesaid conditions of normal illumination obtain within the smoke detection chamber. Then, for example should a sufficient amount of smoke come into the smoke detection chamber such that there is a smoke obscuration of 2% per foot therein, this will result, assuming that the smoke is entirely white smoke, in the reflection of substantial light to the cell 38 to the extent that its received illumination will change from the normal value of 0.0003 foot candles to 0.0004 foot candles, or a change of 0.0001 foot candles (which is approximately 10% of the total illumination received under normal conditions by both of the photocells). The normal value of photo resistance for reflected cell 38 is approximately 500 K ohms. This will change approximately 20% due to the aforesaid change in illumination so that the new resistance value will be approximately 400 K ohms. With this change in photo resistance, the change in base current to the transistor 92 will be such as to produce a collector current change that will finally result in a total change in the current flowing through resistor 84 of approximately 0.020 milliamps. This, in turn, will be sufficient to produce a differential voltage between points 96 and 98 such that a differential bias is applied to the threshold device 102 sufficient to render it conductive and, as explained previously, to cause triggering of device 66 and sounding of the alarm device 64.

The differential voltage in this case, resulting from a greater flow of current than normal through resistor 84, gives rise to a potential at point 96 which is more negative than the potential at point 98.

A change in the opposite direction in parallel branch 80B will produce the same effect on the bias voltage applied to device 102 as was the case previously. That is to say, a decrease in conductivity or — what is the same thing — an increase in the resistance for the direct photocell 36, due to the presence of black smoke, will produce a sufficient bias voltage to cause the threshold device 102 to be rendered conductive. Thus, the decreasing conductivity of photocell 36 will cause a proportionately smaller current to flow through resistor 86 and consequently the point 98 will become more positive than point 96, with, of course, the same effect on the device 102.

It will also be apparent that oppositely directed changes on both of the photocells 36 and 38 together will also result in applying a sufficient and proper bias to the device 102 so as to actuate the alarm device 64. In other words, any combination of white and black smoke will produce in varying proportions the appropriate changes in current and therefore of threshold bias voltage already described.

The objective of providing a suitable trouble signal in the event that either or both of the light-emitting diodes 34 and 54 becomes inoperative will now be described. When either of the diodes 34 or 54 is operational, the voltage across capacitor 112 is clamped to the normal forward bias voltage of the light-emitting diodes 34 and 54 (approximately 5 volts). Such voltage is substantially below the 20 to 30 volt trigger point of the triggering device 114 connected to the capacitor 112 and to a resistor 116, which in turn is connected to the anode of threshold device 102. In the event that either of the light-emitting diodes 34 or 54 fails such that there is an open circuit, the voltage across capacitor 112 rises, this capacitor being charged through resistors 50 and 118. When the voltage across capacitor 112 has risen to the trigger point of device 114, this device is rendered conductive and in turn threshold device 102 and device 66 are rendered conductive, thereby sounding the horn or alarm device 64. In this case, the alarm device 64 remains conductive for only a short time determined by the discharge time of capacitor 112. The charge time is approximately 3 seconds, while the discharge time is approximately 1½ second so that an entirely different audible signal is received, compared with the signal from alarm device 64 when the presence of smoke has been detected. In the latter case, the tone is continuous rather than pulsating.

It has been indicated heretofore that a novel adjustment technique is utilized in order to bring about a precisely desired ratio between the illumination received by the direct cell 36 and that received by the reflected cell 38 such that the potential points 96 and 98, which are connected to the threshold device 102, will have zero potential difference between them. This zero potential difference corresponds to setting the sensitivity 0.4 volts below the trigger point of the threshold device 102. Thus, the trigger point of device 102 is 0.4 volts.

This adjustment technique in accordance with the present invention is performed at the factory so that the customer receives the smoke detector with the adjustment already made. The technique is directed to changing the axis of the light-emitting diode 34, thereby to effectuate the precise illumination ratio desired in order to bring about the balanced circuit condition desired. That is to say, to obtain the aforenoted zero potential difference under normal, or no-smoke circumstances.

Referring now to FIG. 5, it will be seen that the physical adjustment is achieved by pivoting the mounting block 120 on which the light-emitting diode 34 is mounted, the block 120 being swung through a banana slot arrangement 122, in which a pin 124, a pivot 125, and a locking screw 127 are provided. It will be seen that such pin and locking screw are located at the opposite end of the mounting block 120, riding through approximately a ⅛ inch arc. When the proper setting is achieved such that, upon viewing the potential points 96 and 98 (collective voltage differential) by means of an oscilloscope, a zero differential voltage is obtained, the locking screw is then locked.

The above described adjustment technique is preferable to an alternate technique, which can be employed, involving the use of a variable resistor in place of the fixed resistor 90 connected between the direct cell 36 and ground. As noted previously, the light axis adjustment technique of the present invention obviates a difficulty, in that the neutral density filter transmission becomes less critical than it would be ordinarily. Also, the match between the resistances of photocells 36 and 38 becomes less critical, since, in effect, the setting of the light beam axis precisely determines such resistances.

In order to provide the man skilled in the art with a detailed set of specifications for the circuitry of the preferred embodiment, the following types or values of components are given:

| | |
|---|---|
| RESISTORS: | |
| 50 | 4 K ohms, 10W |
| 76 | 47 K ohms, ¼ W |
| 84 | 22 K ohms, ¼ W |
| 86 | 22 K ohms, ¼ W |
| 88 | 220 K ohms, ¼ W |
| 90 | 91 K ohms, ¼ W |
| 100 | 4.7 K ohms, ¼ W |
| 106 | 39 K ohms, ¼ W |
| 110 | 39 K ohms, ¼ W |
| 116 | 4.7 K ohms, ¼ W |
| CAPACITOR 112 | 10 u F, 50 v |
| DIODES: | |
| Light emitting diodes 34 & 54 | Exciton 554-9 |
| Zener diode 78 | 1N5250 |
| 74 | 1N4004 |
| Horn | Edwards Co. Midihorn 123 |
| TRANSISTORS: | |
| 92 and 94 | 2N3393 |
| THRESHOLD DEVICE 102 | MPU131 |
| TRIGGER DEVICES: | |
| 66 | MCR106-4 |
| 114 | 1N5760 |

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. Apparatus for detecting the presence of smoke, comprising:

a. a housing defining an enclosure for the detector;

b. a detection chamber within the enclosure for permitting a continuous air flow so that smoke present therein may be monitored;

c. a solid state, low-level light source mounted within said enclosure so as to provide a predetermined illumination within said detection chamber;

d. first and second light receiving means mounted within the enclosure and adapted to receive a normal illumination in the absence of smoke, each of said light receiving means including a photoresistor;

e. a sensing circuit, in which said first and second light receiving means are connected, for sensing the presence of smoke in said chamber by responding to a change in the normal illumination received by either of said light receiving means, said sensing circuit including two parallel branches, each of which has an output junction point, the photoresistors of the first and second light receiving means being connected in said branches to the respective output junction points between which there is substantially no difference of potential under normal illumination;

f. a threshold device, having at least two input electrodes connected to said respective output junction points in said parallel branches, said threshold device being responsive to the difference in potential between said junction points resulting from said change in the normal illumination received by said light receiving means;

g. alarm signal means connected to said threshold means and actuated thereby to produce an alarm signal.

2. Apparatus as defined in claim 1, in which a neutral filter is disposed in the light path between the light source and said first light receiving means.

3. Apparatus as defined in claim 1, in which the first light receiving means is arranged to receive approximately seventy per cent, while the second light receiving means is arranged to receive approximately thirty per cent, of the total illumination received by both light receiving means under no smoke conditions.

4. Apparatus as defined in claim 1, including a first resistor in each of the parallel branches having its one end connected to the DC supply and its other end connected at one of said junction points to a respective light receiving means; and a second resistor in each of the parallel branches having its one end connected to ground and its other end connected to the respective light receiving means, the ratio of the resistances of the second resistors being substantially the same as the ratio of the resistances, under no smoke conditions, of said photoresistors of the respective light receiving means.

5. Apparatus as defined in claim 1, in which said sensing circuit includes means for producing substantially identical currents in each of said parallel branches under normal or no smoke conditions; and further including means responsive to sufficient changes of conductivity in respectively opposite directions for said first and second light receiving means so as to produce an imbalance in said sensing circuit involving sufficient potential difference between said respective output junction points in said parallel branches so as to trigger said threshold device, thereby to actuate said alarm means.

6. Apparatus as defined in claim 1, in which said first light receiving means is substantially directly on the axis of the conical beam from said light source and is arranged to receive substantially seventy per cent of the normal illumination as defined, whereas the second light receiving means is off the axis and closer to said light source and is arranged to receive approximately thirty per cent of the illumination under no smoke conditions.

7. Apparatus as defined in claim 1, further comprising a trigger device, having an anode, a cathode and a gate electrode, in series with said alarm signal means, the gate electrode of said trigger device being connected to a third electrode of said threshold device.

8. Apparatus as defined in claim 1, in which said solid state, low-level light source provides a predetermined illumination of the order of 0.009 foot candles within said detection chamber and in which said first and second light receiving means mounted within the enclosure are arranged to receive a normal illumination in the absence of smoke of the order of 0.001 foot candles.

9. Apparatus as defined in claim 1, in which said solid state, low-level light source is a light emitting diode.

10. Apparatus as defined in claim 1, further comprising a transistor voltage-amplifying device connected to each of said light receiving means, the photoresistor of the first and second light receiving means being in parallel with the collector and base of the respective transistor devices, the emitter of each of said transistor devices being connected to ground.

11. Apparatus as defined in claim 10, in which said transistor devices have their said emitters connected through a common resistor to ground so as to eliminate spurious noise signals.

12. Apparatus as defined in claim 1, in which said housing includes a cover and a base plate;

integral partitions formed in said cover for defining said detection chamber;

an inlet opening to said housing and an outlet opening therefrom for permitting said continuous air flow;

a labyrinthine passageway adjoining said inlet opening and a further passageway adjacent said outlet opening, said passageways acting to insure that the enclosure is light-tight;

a printed circuit board engaging said base plate, the partitions defining said smoke chamber and the partitions defining said passageways each extending so as to abut said printed circuit board.

13. Apparatus as defined in claim 12, further comprising a separate compartment within said enclosure for surrounding said first light receiving means, a filter disposed in slots formed in a partition defining said compartment.

14. Apparatus as defined in claim 13, further comprising means for simulating smoke within said chamber so as to test the operation of said smoke detection apparatus, including a rotatable shaft engageable from outside said housing, said shaft having a wire extendable into the path of light from said source, said shaft having a knob at the outer end thereof, said knob being flush with the top surface of the cover for said housing.

* * * * *